US008427337B2

(12) United States Patent
Wilbur et al.

(10) Patent No.: US 8,427,337 B2
(45) Date of Patent: Apr. 23, 2013

(54) PLANAR DIPOLE ANTENNA

(75) Inventors: Mark S. Wilbur, Concord, OH (US); James R. Pollock, Hudson, OH (US); Justin M. Hennigan, Ashtabula, OH (US)

(73) Assignee: Aclara RF Systems Inc., Solon, OH (US)

( * ) Notice: Subject to any disclaimer, the term of this patent is extended or adjusted under 35 U.S.C. 154(b) by 249 days.

(21) Appl. No.: 12/832,332

(22) Filed: Jul. 8, 2010

(65) Prior Publication Data

US 2011/0006911 A1 Jan. 13, 2011

Related U.S. Application Data

(60) Provisional application No. 61/224,766, filed on Jul. 10, 2009.

(51) Int. Cl.
*H01Q 9/26* (2006.01)
*H01Q 9/28* (2006.01)
*H01Q 1/38* (2006.01)

(52) U.S. Cl.
USPC ..... 340/870.02; 343/793; 343/803; 343/807; 343/816; 343/822; 343/845; 343/846; 343/850; 343/852; 343/862; 343/863; 343/908

(58) Field of Classification Search ..... 340/870.02, 340/870.03; 343/700 MS, 702, 719, 767, 343/770, 793, 795, 803, 807, 816, 820–822, 343/843, 845, 846, 850, 852, 860, 862, 863, 343/873, 908
See application file for complete search history.

(56) References Cited

U.S. PATENT DOCUMENTS

| | | | | |
|---|---|---|---|---|
| 4,387,379 | A | 6/1983 | Hardie | |
| 4,780,724 | A | 10/1988 | Sharma et al. | |
| 4,978,965 | A | 12/1990 | Mohuchy | |
| 5,268,701 | A | 12/1993 | Smith | |
| 5,914,695 | A | 6/1999 | Liu et al. | |
| 5,952,896 | A | 9/1999 | Mett et al. | |
| 5,999,141 | A * | 12/1999 | Weldon | 343/803 |
| 6,018,324 | A | 1/2000 | Kitchener | |

(Continued)

OTHER PUBLICATIONS

Madhuri Bharadwaj Eunni, "*A Novel Planar Microstrip Antenna Design for UHF RFID*," B.E., Electronics and Communication Engineering, A.M.A. College of Engineering, Kancheepuram-Madras University, India, pp. 1-116, May 2004.

(Continued)

*Primary Examiner* — Levi Gannon
(74) *Attorney, Agent, or Firm* — Brinks Hofer Gilson & Lione

(57) ABSTRACT

A planar dipole antenna is described. The antenna may include a ground element, a feed point, a matching element, and first and second radiating elements disposed on a substrate, and a feed point. The ground element may have a substantially rectangular shape and the feed point may be arranged adjacent to the ground element. The matching element may be connected to the feed point and may include a central bar connected to a first and second arm. The first and second arms may be substantially symmetrically disposed on the substrate in respect to the central bar. The first and second radiating elements may have substantially trapezoidal shapes and may be extend from the first and second arms of the matching element, respectively. The first and second radiating elements may be substantially symmetrically disposed on the substrate in respect to the central bar of the matching element.

25 Claims, 12 Drawing Sheets

U.S. PATENT DOCUMENTS

| | | | | |
|---|---|---|---|---|
| 6,163,306 | A | 12/2000 | Nakamura et al. | |
| 6,181,294 | B1 | 1/2001 | Porter et al. | |
| 6,323,811 | B1 | 11/2001 | Tsubaki et al. | |
| 6,424,311 | B1 | 7/2002 | Tsai et al. | |
| 6,429,828 | B1 | 8/2002 | Tinaphong et al. | |
| 6,459,415 | B1 | 10/2002 | Pachal et al. | |
| 6,486,834 | B2 | 11/2002 | Tsai | |
| 6,486,836 | B1 | 11/2002 | Hill | |
| 6,518,935 | B2 | 2/2003 | Louzir et al. | |
| 6,559,809 | B1 * | 5/2003 | Mohammadian et al. | 343/795 |
| 6,606,065 | B1 | 8/2003 | Payne et al. | |
| 6,747,605 | B2 | 6/2004 | Lebaric et al. | |
| 6,762,724 | B2 | 7/2004 | Peng | |
| 6,778,141 | B1 | 8/2004 | Yeh | |
| 6,819,287 | B2 | 11/2004 | Sullivan et al. | |
| 6,859,176 | B2 | 2/2005 | Choi | |
| 6,906,678 | B2 | 6/2005 | Chen | |
| 7,012,573 | B2 | 3/2006 | Tchistiakov et al. | |
| 7,023,386 | B2 | 4/2006 | Habib et al. | |
| 7,088,299 | B2 | 8/2006 | Siegler et al. | |
| 7,095,382 | B2 | 8/2006 | Surducan et al. | |
| 7,129,898 | B1 | 10/2006 | Chou | |
| 7,193,565 | B2 * | 3/2007 | Caimi et al. | 343/700 MS |
| 7,196,673 | B2 | 3/2007 | Savage et al. | |
| 7,212,171 | B2 | 5/2007 | Lee | |
| 7,215,285 | B2 | 5/2007 | Song et al. | |
| 7,215,296 | B2 | 5/2007 | Abramov et al. | |
| 7,242,364 | B2 * | 7/2007 | Ranta | 343/860 |
| 7,268,737 | B1 | 9/2007 | Ai et al. | |
| 7,274,338 | B2 * | 9/2007 | Ozkar et al. | 343/793 |
| 7,292,202 | B1 | 11/2007 | Althouse | |
| 7,321,333 | B2 | 1/2008 | Tsai et al. | |
| 7,339,543 | B2 | 3/2008 | Wang et al. | |
| 7,369,013 | B2 | 5/2008 | Fazzio et al. | |
| 7,541,991 | B2 | 6/2009 | Qi et al. | |
| 8,063,839 | B2 * | 11/2011 | Ansari et al. | 343/745 |
| 2001/0033250 | A1 | 10/2001 | Keilen et al. | |
| 2006/0054710 | A1 | 3/2006 | Forster et al. | |
| 2007/0063915 | A1 | 3/2007 | Savage et al. | |
| 2007/0085750 | A1 | 4/2007 | De Angelis | |
| 2007/0091006 | A1 | 4/2007 | Thober et al. | |
| 2007/0279231 | A1 | 12/2007 | Cheng et al. | |
| 2008/0042907 | A1 | 2/2008 | Webb et al. | |
| 2008/0062055 | A1 | 3/2008 | Cunningham | |
| 2008/0068175 | A1 | 3/2008 | Hockey et al. | |
| 2008/0068216 | A1 | 3/2008 | Borisov et al. | |
| 2008/0074283 | A1 | 3/2008 | Verkleeren et al. | |
| 2008/0079640 | A1 | 4/2008 | Yang | |
| 2008/0079642 | A1 | 4/2008 | Ishizuka et al. | |
| 2008/0088511 | A1 | 4/2008 | Sorvala et al. | |
| 2008/0088521 | A1 | 4/2008 | Le et al. | |
| 2008/0129420 | A1 | 6/2008 | Borisov et al. | |
| 2008/0129605 | A1 | 6/2008 | Sakurai et al. | |
| 2008/0129626 | A1 | 6/2008 | Wu et al. | |
| 2008/0136712 | A1 | 6/2008 | Suzuki | |
| 2008/0146183 | A1 | 6/2008 | Gebara et al. | |
| 2008/0297418 | A1 | 12/2008 | Hu et al. | |
| 2009/0051614 | A1 | 2/2009 | Wong et al. | |
| 2009/0109106 | A1 | 4/2009 | Tsubaki et al. | |

OTHER PUBLICATIONS

HF Antenna Design Notes Technical Application Report, "Radio Frequency Identification Systems," Texas Instruments, 46 pages, dated Sep. 2003.

Markus Laudien, "Radio Frequency Identification (RFID) Antenna and System Design," Ansoft Corporation, at: http://www.ansoft.com/converge/laudien$_{13}$ansoft1.pdf, 39 pages, (last visited Jul. 9, 2009).

Gary Breed, "Basic Principles of Electrically Small Antennas," Summit Technical Media, LLC, 3 pages, dated Feb. 2007.

"Some Properties and Principles of Antennas," at: http://eelinux.ee.usm.maine.edu/courses/ele351/Antennas%20Tutorial.doc, 16 pages, (last visited Jul. 9, 2009).

Ingecom, "Application Note 01 V/UHF Antenna Design," pp. 1-14, dated Mar. 17, 2000.

Freescale Semiconductor Application Note, "Compact Integrated Antennas, Designs and Applications for the MC1319x, MC1320x, and MC1321x," Freescale Semiconductor, Inc., Do. No. AN2731, Rev. 1.4, 20 pages, 2005, 2006.

Chenard et al., "Design Methodology for Wireless Nodes with Printed Antennas," Department of Electrical and Computer Engineering McGill University, Montréal, Québec, Canada, pp. 291-296, dated Jun. 2005.

D. Jefferies, "Single-stub matching of transmission lines to loads," at: http://personal.ee.surrey.ac.uk/Personal/D.Jefferies/jefferies-stub.html, pp. 1-8, (last revised May 20, 2003, last visited Jul. 9, 2009).

"Some Notes on Antenna Matching and Measurement for Small RFID Tags," at: http://micro-rfid.org/pdf/antenna1.pdf, 10 pages, (last visited Jul. 9, 2009).

Maxim Integrated Products, "Application Note 742, Impedance Matching and the Smith Chart: The Fundamentals," pp. 1-18, Jul. 22, 2002.

Frederick R. Vobbe, "Understanding The Smith Chart," http://hf-antenna.com/schart/, pp. 1-5, dated Nov. 18, 2008 (last visited Jul. 9, 2009).

Bill Rau, "Brushing Up on VSWR," Penton Media, Inc., pp. 1-4, dated Jan. 1, 1998.

VSWR-Microwave Encyclopedia, "Voltage standing wave ratio (VSWR)," at: http://www.microwaves101.com/encyclopedia/vswr.cfm, pp. 1-7, updated Aug. 26, 2008.

Kent Smith, "Antennas for Low Power Applications," at: http://www.rfm.com/corp/appdata/antenna.pdf, 16 pages, (last visited Jul. 9, 2009).

Chan & Harter, "Impedance matching and the Smith chart—The fundamentals," RF Antennas TX/RX, 8 pages, Jul. 2000.

Tom Yestrebsky, "Application Note 23—MICRF001 Antenna Design Tutorial," Micrel, Inc., pp. 1-8, Jul. 1999.

Aclara, "The Aclara STAR® Network Water Meter Transmission Unit (MTU)," at: http://www.aclaratech.com/AclaraRF/Pages/specifications_WaterMTU.aspx, 1 page, 2008 (last visited Jul. 2, 2009).

Aclara, "Aclara STAR Network Data Collector Unit (DCU) II," at: http://www.aclaratech.com/AclaraRF/Pages/specifications_DCU.aspx, 1 page, 2008, (last visited Jul. 2, 2009).

Aclara, "The Aclara STAR® Network NCC Network Control Computer," at: http://www.aclaratech.com/AclaraRF/Pages/specifications_NCC.aspx, 1 page, 2008, (last visited Jul. 2, 2009).

Aclara, "The Aclara STAR® Network Electric meter Transmission Unit (MTU)," at: http://www.aclaratech.com/AclaraRF/Pages/specifications_ElectricMTU.aspx, 1 page, 2008 (last visited Jul. 2, 2009).

Aclara, "The Aclara STAR® Network Gas Meter Transmission Unit (MTU)," at: http://www.aclaratech.com/AclaraRF/Pages/specifications_GasMTU.aspx, 1 page, 2008, (last visited Jul. 2, 2009).

Aclara, "STAR Network AMI System," at: http://www.aclaratech.com/AclaraRF/pages/starsystem.aspx, 2 pages, 2008, (last visited Jul. 2, 2009).

David McCartney, "Embedded antennas—technology for next generation handsets," RF tx/rx, 4 pages, Apr. 2000.

"Chapter 4—Microstrip Patch Angenna Design and Results," at: http://etd.lib.fsu.edu/theses/available/etd-04102004-143656/unrestricted/Chapter4.pdf, pp. 48-58, (last visited Jul. 9, 2009).

Jeremy Smith, "Antenna Tutorial," Aerocomm, at: http://aerocomm.com/docs/Antenna_Tutorial.pdf, 11 pages, (last visited Jul. 9, 2009).

"12—Impedance Matching," at http://www.ece.rutgers.edu/~orfanidi/ewa/ch12.pdf, 25 pages, (last visited Jul. 9, 2009).

Jie Nie, "ASH Transceiver Antenna Impedance Matching," pp. 1-10, Nov. 2, 2001.

Dragoslav Dobričić, "Yagi Antenna Q factor," antenneX Issue No. 135, pp. 1-12, Jul. 2008.

Big Spark Media, "Detune," http://www.rfidtribe.com/index.php?option=com_content&view=article&id=161&itemid=99, 1 page, (last visited May 7, 2009).

Wikipedia, "Interference (wave propagation)," http://en.wikipedia.orq/w/index.php?title=interference_wave_propagation)&printable=yes, pp. 1-7, (last modified Jun. 10, 2009, last visited Jun. 17, 2009)

Wikipedia, "Dipole antenna," http://en.wikipedia.org/w/index.php?title=Dipole_antenna&printable=yes, pp. 1-15, (last modified May 6, 2009, last visited May 7, 2009).

Huang and Chen, "A Compact Omni-Directional UHF Antenna for DTV Broadcasting Reception," at: http://www.ursi.org/Proceedings/ProcGA02/papers/p2226.pdf, Graduate Institute of Communication Engineering—Tatung University, 4 pages, (last visited Jul. 9, 2009).
Kin-Lu Wong, "Advanced Planar Antenna Designs for Wireless Devices," at: http://www.ansoft.com/deliveringperformance/NSYSU2.pdf, pp. 1-36, (last visited Jul. 9, 2009).
Wikipedia, "Ultra high frequency," http://en.wikipedia.org/w/index.php?title=Ultra_high_frequency&printable=yes, pp. 1-16, (last modified Jun. 11, 2009, last visited Jun. 15, 2009).
Wikipedia, "Radio-frequency identification," http://en.wikipedia.org/w/index.php?title=Radio-frequency_identification&printable=yes, pp. 1-18, (last visited Jun. 15, 2009).
Gaetano Marrocco, "The art of UHF RFID antenna design: impedance matching and size-reduction techniques," IEEE Antennas and Propagation Magazine, Vo. 50, No. 1, pp. 1-21, Jan. 2008.
Bancroft & Bateman, "Design of a Planar Omnidirectional Antenna for Wireless Applications," at: http://www.centurion.com/home/pdf/wp_omni_wireless.pdf, pp. 1-8, (last visited: Jul. 9, 2009).
Fan et al., "A Miniaturized 2.45 GHz RFID Tag Antenna Using Planar Impedance Transformer," PIERS Online, vol. 3, No. 7, pp. 951-954, 2007.
Meier & Jhangiani, "Evaluate Test System Impedance Matching and Switch Quality," at: http://www.mwrf.com/Articles/Index.cfm?ArticleID=16650, Microwaves & RF, pp. 1-3, Sep. 2007, (last visited Jun. 25, 2009).
Rick Nelson, "How does a Smith chart work?," at http://www.tmworld.com/index.asp?layout=articlePrint&articleID=CA187342, Test & Measurement World, Jul. 2001, (last visited Jul. 9, 2009).
Allen Hollister, "Smith Charts—Appendix A—Scattering Parameters & Smith Charts," at: http://www.allenhollister.com/allen/files/scatteringparameters.pdf, 2007, last visited: Jul. 9, 2009.
Wikipedia, "Characteristic impedance," http://en.wikipedia.org/w/index.php?title=Characteristic_impedance&printable=yes, pp. 1-4, (last modified May 29, 2009, last visited Jun. 25, 2009).
Vasiliadis et al., "A Wideband Printed Dipole Antenna With Optimized Tapered Feeding Balun for ISM and FWA Bands," Telecommuncations Laboratory—Aristotle Univerity of Thessaloniki, pp. 1-15.
Wikipedia, "Scattering parameters," http://en.wikipedia.org/w/index.php?title=Scattering_parameters&printable=yes, pp. 1-19, (last modified May 20, 2009, last visited Jun. 15, 2009).
Wikipedia, "Smith chart," http://en.wikipedia.org/wiki/Smith_chart, pp. 1-11, (last modified May 5, 2009, last visited May 7, 2009).
Agilent Technologies, "RF & Microwave References," at: http://sss-mag.com/pdf/agilentRFsmithposter.pdf, (last visited Jul. 9, 2009).
"1—Maxwell's Equations," at: http://www.ece.rutgers.edu/~orfanidi/ewa/ch01.pdf, 18 pages (last visited Jul. 9, 2009).

* cited by examiner

800

PLANAR DIPOLE ANTENNA

CROSS-REFERENCE TO RELATED APPLICATIONS

This application claims the benefit of U.S. Provisional Application No. 61/224,766, filed on Jul. 10, 2009, which is incorporated by reference herein.

BACKGROUND

The utility industry has long grappled with the issue of reading utility meters without inconveniencing a homeowner. The issue was particularly noticeable as it related to reading water meters in geographic areas subject to freezing temperatures. In order to prevent damage from the freezing temperatures, the water meters were installed inside the residences. Thus, a representative of the utility company needed access to the inside of the residence in order to read the meter, creating an inconvenience for both the homeowner and the utility company.

In an effort to alleviate the problems associated with physically reading utility meters, utility companies deployed remote meter transmission units. In general, a remote meter transmission unit may remotely read a utility meter and transmit meter readings or other meter related information, directly or indirectly, back to a utility company. The remote meter transmission units often transmit the meter readings via radio frequency signals, such as to a central reading station, or a data collector unit. In some instances the radio frequency signal may be transmitted over relatively long distances, such as a mile or more. Thus, the remote meter transmission units may require a robust antenna capable of transmitting the meter readings the necessary distances.

In some instances the remote meter transmission unit and antenna may be housed within the meter itself. Alternatively the remote meter transmission unit and antenna may be housed within a separate enclosure. In either case the antenna may be subject to size constraints. In addition, the antenna may often be surface mounted in order to meet the size constraints and/or in order to effectively transmit the signal, such as to a data collector unit. Often the antennas may be situated near other components of the remote meter transmission unit or components of the meter itself. The close proximity to the components may affect the efficiency of the antenna in radiating the desired signals. For example, materials such as metals, plastic or concrete can affect the radiating pattern of an antenna. In addition, the proximity of the materials to the antenna may cause the antenna to become detuned. That is, the materials may change the frequency at which the antenna propagates signals. A detuned antenna may not be capable of effectively transmitting the meter readings, such as to a data collector unit. The antenna can also suffer from detuning if it is situated near metallic structures, such as the utility meter itself.

Thus, in order for an antenna to be properly suited for remote meter reading applications, the design of the antenna should achieve a balance between physical size, radio frequency performance and mechanical strength such that the antenna has a small form factor capable of being surface mounted without suffering from near field detuning.

SUMMARY

A planar dipole antenna may include a substrate, a ground element, a feed point, a matching element, a first radiating element and a second radiating element. The ground element may be disposed on the substrate having a substantially rectangular shape. The feed point to which an input signal is supplied may be arranged adjacent to a side of the ground element. The matching element may be disposed on the substrate and connected to the feed point. The matching element may include a central bar connected to a first arm and second arm. The first arm and the second arm may be substantially symmetrically disposed on the substrate in respect to the central bar. The first radiating element may be disposed on the substrate having a substantially trapezoidal shape and being connected to the matching element. The first radiating element may extend from the first arm of the matching element. The second radiating element may be disposed on the substrate having a substantially trapezoidal shape and connected to the matching element. The second radiating element may extend from the second arm of the matching element. The first radiating element and the second radiating element may be substantially symmetrically disposed on the substrate in respect to an axis formed by the central bar of the matching element.

DETAILED DESCRIPTION

In the disclosed embodiments, an antenna structure is presented for a small form factor planar dipole antenna capable of producing ideal radiation patterns for surface mounted applications while being minimally affected by adjacent materials and manufacturing variations such that the antenna does not suffer from near field detuning. The radiating elements of the antenna may allow the antenna to produce radiation patterns which may be ideal for surface mounted applications, while a self-contained matching element may allow the antenna to achieve a substantially low Q factor, thereby preventing near field detuning. The matching element may also ensure the impedance of the antenna matches the input impedance, which may maximize the performance of the antenna. The antenna may be optimal for surface mounted applications requiring an antenna with a small form factor which is minimally affected by adjacent components or substrate materials, such as remote meter transmission units. The antenna may also be optimal for other communication applications such as Home Area Networks.

Other systems, methods, features and advantages may be, or may become, apparent to one with skill in the art upon examination of the following figures and detailed description. It is intended that all such additional systems, methods, features and advantages be included within this description, be within the scope of the embodiments, and be protected by the following claims and be defined by the following claims. Further aspects and advantages are discussed below in conjunction with the description.

Figure 1:
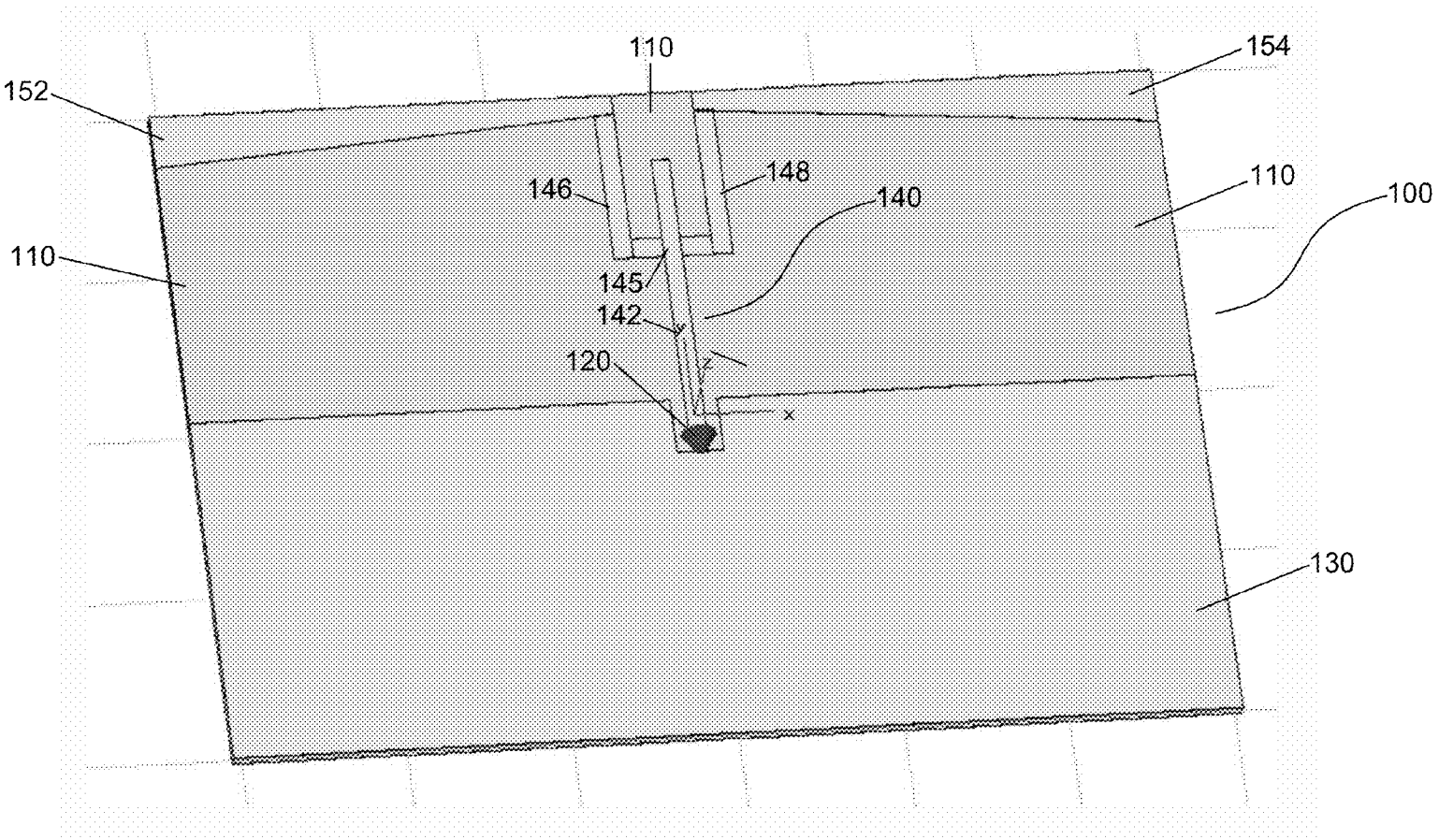
FIG. 1 is an illustration of a planar dipole antenna.

Turning now to the drawings, FIG. 1 provides an illustration of a planar dipole antenna 100. Not all of the depicted components may be required, however, and some implementations may include additional components. Variations in the arrangement and type of the components may be made without departing from the spirit or scope of the claims as set forth herein. Additional, different or fewer components may be provided.

The planar dipole antenna 100 may include a feed point 120, a ground element 130, a matching element 140, a first radiating element 152, and a second radiating element 154, and may be disposed on a substrate 110, such as a dielectric substrate. The matching element 140 may include a central bar 142, a first arm 146, and a second arm 148. The first and second arms 146, 148 may be connected to the central bar 142 at a connection point 145.

The material of the ground element 130, matching element 140, and radiating elements 152, 154 may be any electrically conductive material which may be disposed to the substrate 110, such as copper, brass, or aluminum. The ground element 130, matching element 140, and radiating elements 152, 154 may be adhered to, etched to, or inked onto the substrate 110. The material of the substrate 110 may be a printed circuit board (PCB) made of a fiberglass reinforced epoxy resin (FR4), a Bismaleimide-triazine (BT) resin, or any other non-conductive or insulating material such that the potential for antenna interference is minimized and the antenna's radiation performance is maximized. The radiating performance of the antenna 100 may be minimally affected by variances in the materials used for the substrate 110. The antenna 100 may be an electrically small antenna. For example, the antenna 100 may have an electrical length of approximately an eighth wavelength or less in a frequency band. The antenna 100 may often be oriented such that its primary plane of polarization is horizontal. In one example, the antenna 100 may operate at a resonant frequency of approximately 460 megahertz (MHz). In this example the antenna 100 may have dimensions of approximately 200 mm×300 mm and the substrate may have a thickness on an order of approximately 1.575 mm. Alternatively or in addition, the shape of the antenna 100 may be adjusted to accommodate a large range of frequencies, such as from 400 MHz to 5 gigahertz (GHz). For example, the scale of the antenna 100 may be decreased by fifty percent to accommodate a frequency of 920 MHz.

The ground element 130 may have a substantially rectangular shape and may be located at the base of the antenna 100. In the example where the antenna 100 operates at a resonant frequency of approximately 460 MHz, the dimensions of the ground element may be approximately 50 mm×300 mm. The ground element 130 may be connected to, or adjacent to, the feed point 120. The side of the ground element 130 adjacent to the feed point may have an opening, or notch. The feed point 120, and part of the central bar 142 of the matching element 140, may be situated within the opening of the ground element 130. In the example where the antenna 100 operates at a resonant frequency of approximately 460 MHz, the opening of the ground element 130 may extend approximately 10 mm into the ground element 130 and approximately 25 mm across the ground element 130. The feed point 120 may be connected to a transmission line which provides an interface for forming an electrical connection between the antenna 100 and a radio frequency signal source, such as a transceiver or a radio frequency communications module within a utility meter. The feed point 120 may also be connected to the central bar 142 of the matching element 140.

The matching element 140 may match the impedance of the antenna 100, often ten ohms, to the input impedance at the feed point 120, often fifty ohms. If the antenna impedance is not properly matched to the input impedance, the transmission range of the antenna 100 may be reduced. The matching element 140 may effectively match the antenna impedance to the input impedance as shown and discussed in the Smith chart of FIG. 2 below and the return loss graph of FIG. 3 below. The matching element 140 may also allow the antenna 100 to have a substantially low Q factor such that the antenna 100 is substantially resistant to near-field detuning. In other words, the near-field detuning of the antenna 100 is substantially minimized or substantially eliminated, as shown and discussed in the Smith chart of FIG. 2 below.

The matching elements 140 may be substantially self-contained within the antenna 100, or substantially contained within the antenna 100. The central bar 142 of the matching element may extend from the feed point 142 at an angle substantially perpendicular to the ground element 130. In the example where the antenna 100 operates at a resonant frequency of approximately 460 MHz, the central bar 142 of the matching element 140 may have dimensions of approximately 20 mm×30 mm×0.001 mm. The first arm 146 and second arm 148 may be connected to the central bar 142 at the connection point 145. In the example where the resonant frequency of the antenna is approximately 460 MHz, the connection point 145 may be located approximately 35 mm from the feed point 120. The arms 146, 148 may straddle the central bar 142 such that the matching element 140 has a form factor which may be described as a three finger-like form factor, a three prong-like form factor, a pitchfork-like form factor, or trident-like form factor.

The arms 146, 148 may be substantially symmetrically disposed on opposite sides of the central bar 142. The arms 146, 148 may have a horizontal part and a vertical part such that the arm 146 forms an L-shaped arm, while the arm 148 forms a reverse L-shaped arm. In the example where the antenna 100 operates at a resonant frequency of approximately 460 MHz, the horizontal part of the arms 144, 146 may have dimensions of approximately 2 mm×50 mm×0.001 mm, while the vertical part of the arms 144, 146 may have dimensions of approximately 2 mm×25 mm×0.001 mm. The arms 146, 148 may extend beyond the length of the central bar 142. In the example where the antenna 100 operates at a resonant frequency of approximately 460 MHz, the arms 146, 148 may extend approximately 40 mm past the end of the central bar 142. The distal end of the first arm 146, in respect to the central bar 142, may be connected to the first radiating element 152, and the distal end of the second arm 148, in respect to the central bar 142, may be connected to the second radiating element 154. The first radiating element 152 may be connected substantially perpendicularly to the first arm 146 and the second radiating element 154 may be connected substantially perpendicularly to the second arm 148.

The radiating elements 152, 154 may collect/radiate radio frequency energy to provide the radiation pattern of the antenna 100, which may be ideal for surface mounted applications. The radiating elements 152, 154 may be substantially symmetrically disposed on opposite sides with respect to an axis formed by the central bar 142. This configuration may maximize the radiation efficiency of the antenna 100 to provide a symmetrical radiation pattern. The radiation pattern of the antenna 100 is demonstrated by the e-plane radiation pattern of FIG. 4, the h-plane radiation pattern of FIG. 5, the E-field strength graph of FIG. 6, and the far field radiation graph of FIG. 7. The radiating elements 152, 154 may have substantially trapezoidal shapes each having four sides. The parallel sides of the trapezoidal shaped radiating elements 152, 154 may also be parallel to the central bar 142. In the example where the antenna 100 operates at a resonant frequency of approximately 460 MHz, the sides of the radiating elements 152, 154 may have dimensions of approximately 65 mm×2 mm, and the height of the radiating elements 152, 154 may be approximately 8 mm. The substrate 110 may separate the radiating elements 152, 154 from the ground element 130. In the example where the antenna operates at a resonant frequency of approximately 460 MHz, the radiating elements 152, 154 may be separated from the ground element 130 by a distance of approximately 50 mm.

Alternatively or in addition, the substrate 110 may have a first surface and a second surface. The ground element 130, matching element 140, and radiating elements 152, 154 may be disposed on the first surface of the substrate 110, while a second ground element may be disposed on the second surface of the substrate 110. In this case, the second ground element may be disposed over the entire second surface of the substrate 110.

Figure 2:
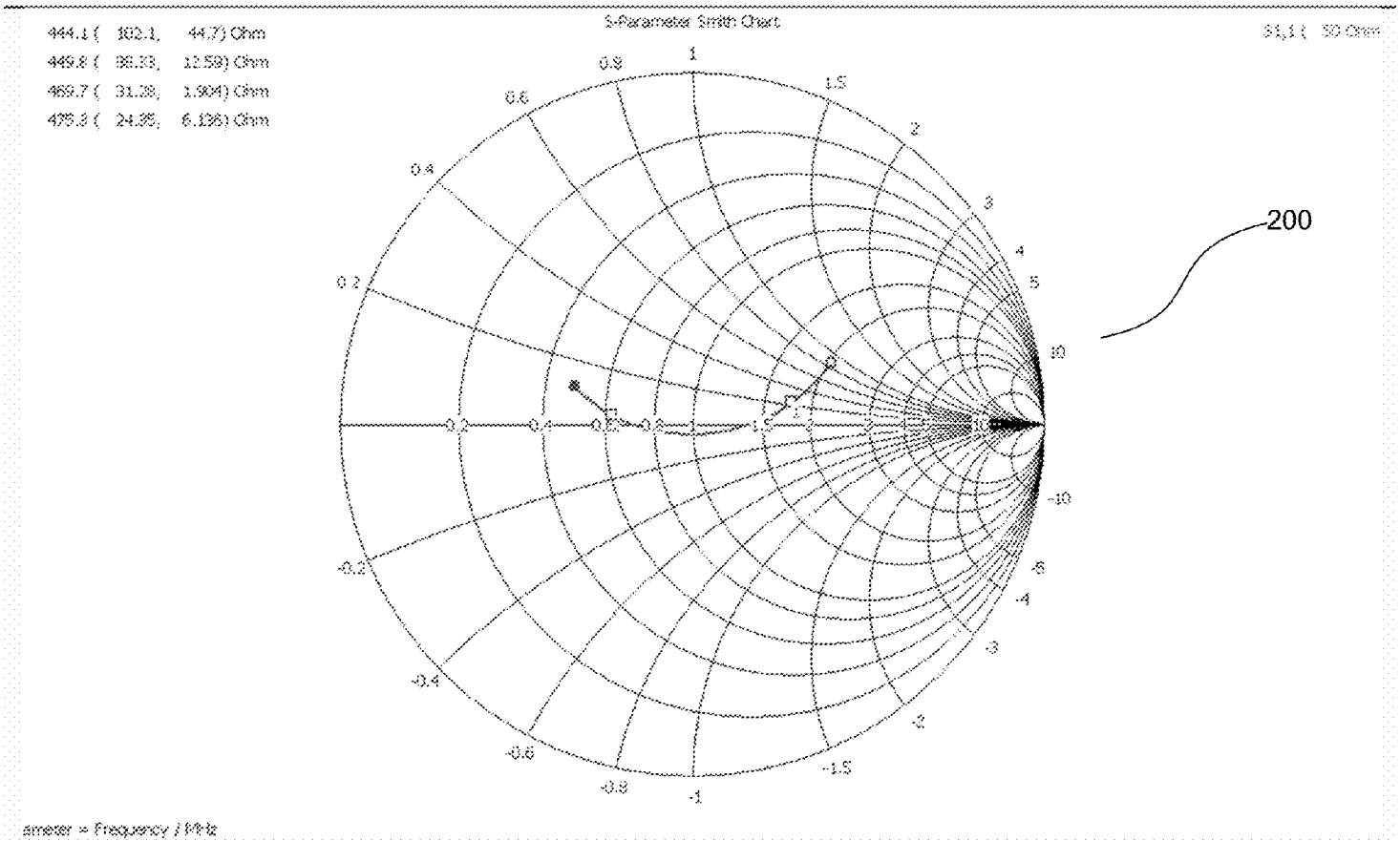
FIG. 2 is a Smith chart showing the complex impedance of the planar dipole antenna of FIG. 1 operating at multiple frequencies.

FIG. 2 is a Smith chart 200 showing the complex impedance of the planar dipole antenna 100 of FIG. 1. The Smith chart 200 plots the S11 scattering parameter ("S-parameter") for the antenna 100 across four frequencies: 444.1 MHz, 449.8 MHz, 469.7 MHz and 475.3 MHz for a 50 ohm input impedance. The S11 S-parameter refers to the ratio of signal that reflects from the antenna 100 for a signal incident to the antenna 100, also referred to as the reflection coefficient of the antenna 100. The Smith chart 200 demonstrates that the impedance of the antenna 100 at resonance, where the imaginary part of the impedance vanishes, is between 40 ohms and 75 ohms for a 50 ohm input impedance. Since the impedance at resonance is nearly equivalent to the input impedance of 50 ohms, the Smith chart demonstrates that the matching network 140 is effectively matching the antenna impedance with the input impedance. Thus, the matching network 140 is also effectively tuning the antenna 100 at the resonant frequency. The Smith chart 200 shows the resonant frequency of the antenna 100 falling between 449.8 MHz and 469.7 MHz, or approximately 460 MHz.

The Q, or quality factor, may be a measurement of the effect of a resonant system's resistance to oscillation, or the resistance of an antenna 100 to changes in the resonant frequency. A low quality Q implies high resistance to oscillation. For a complex impedance, the Q factor is the ratio of the reactance to the resistance. As shown in the Smith Chart, the Q factor at 469.7 MHz is 31.28 ohms divided by 1.904 ohms, or approximately 0.06086. The Q factor may be even lower at the resonance frequency of approximately 460 MHz. Since the antenna 100 has a substantially low Q factor at the resonance frequency, the antenna 100 may be highly resistive to oscillations. In other words, the antenna 100 may be highly resistant to near field detuning.

Figure 3:
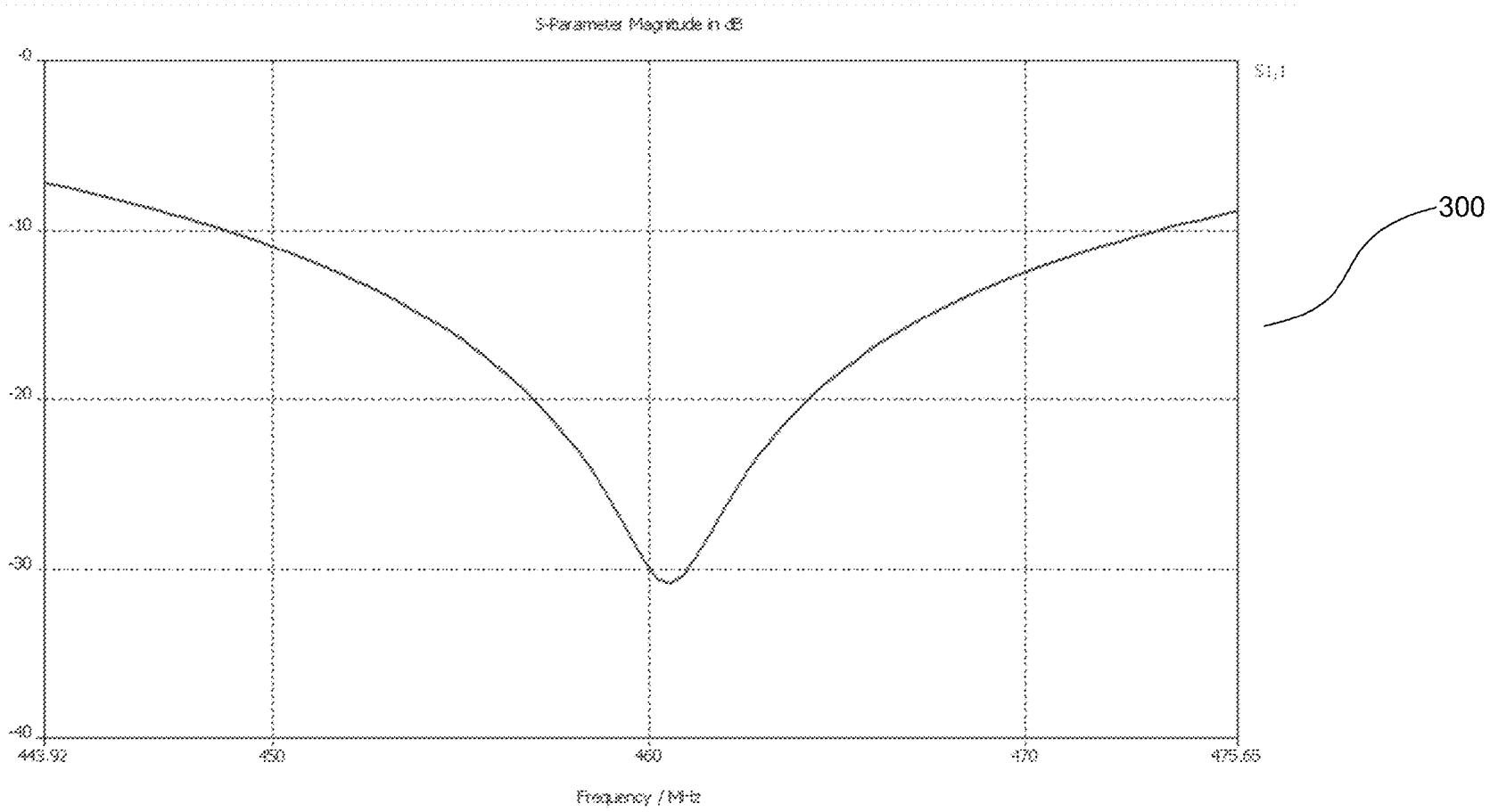
FIG. 3 is a return loss graph illustrating reflection loss with respect to a frequency in the self-tuning dipole antenna of FIG. 1.

FIG. 3 is a return loss graph 300 illustrating reflection loss with respect to a frequency in the self-tuning dipole antenna 100 of FIG. 1. The return loss of the antenna 100 may refer to the reflection loss with respect to a frequency of the antenna 100, or the difference in power (expressed in decibels (dB)) between the input power and the power reflected back by the load due to a mismatch. Thus, the radiation efficiency of the antenna 100 may be maximized when the return loss is minimized. The return loss graph 300 demonstrates the antenna 100 has a reflection loss of at least 10 dB in a frequency band between approximately 450 MHz and 470 MHz. The return loss graph 300 demonstrates the antenna achieves a reflection loss of approximately 30 dB at a frequency of approximately 460 MHz. The substantially low reflection loss at the approximate resonance frequency indicates that the matching network 140 is effectively matching the antenna impedance to the input impedance, thereby maximizing the radiation efficiency of the antenna 100.

Figure 4:
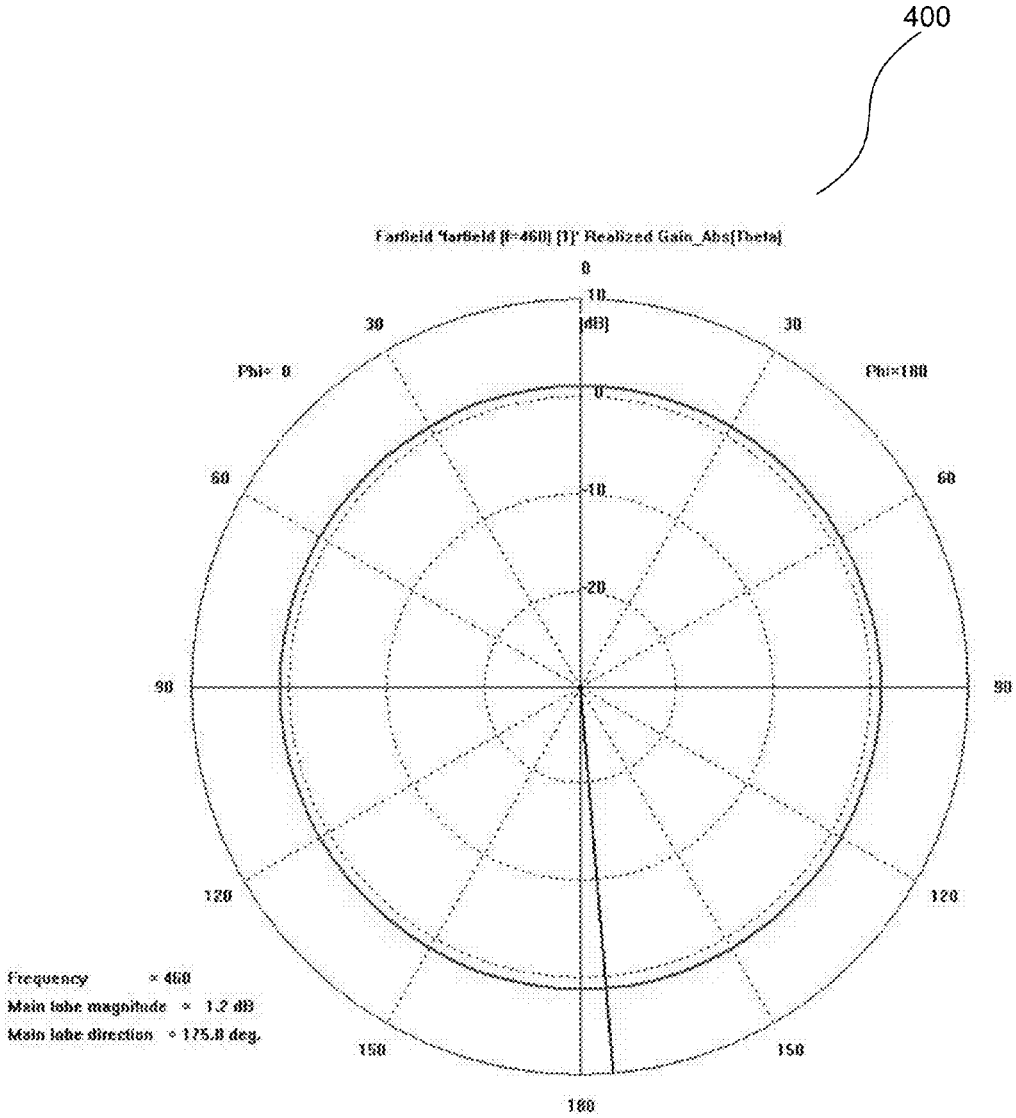
FIG. 4 is an E-plane radiation pattern of the planar dipole antenna of FIG. 1 operating at a frequency of 460 MHz.

FIG. 4 is an E-plane radiation pattern 400 of the planar dipole antenna 100 of FIG. 1 operating at a frequency of 460 MHz. The E-plane radiation pattern 400 represents the far-field conditions along the electrical field vector along the direction of maximum radiation. Since the antenna 100 is often horizontally-polarized, the E-Plane coincides with the horizontal or azimuth plane. Alternatively, if the antenna 100 is vertically-polarized, the E-plane may coincide with the vertical or elevation plane.

Figure 5:
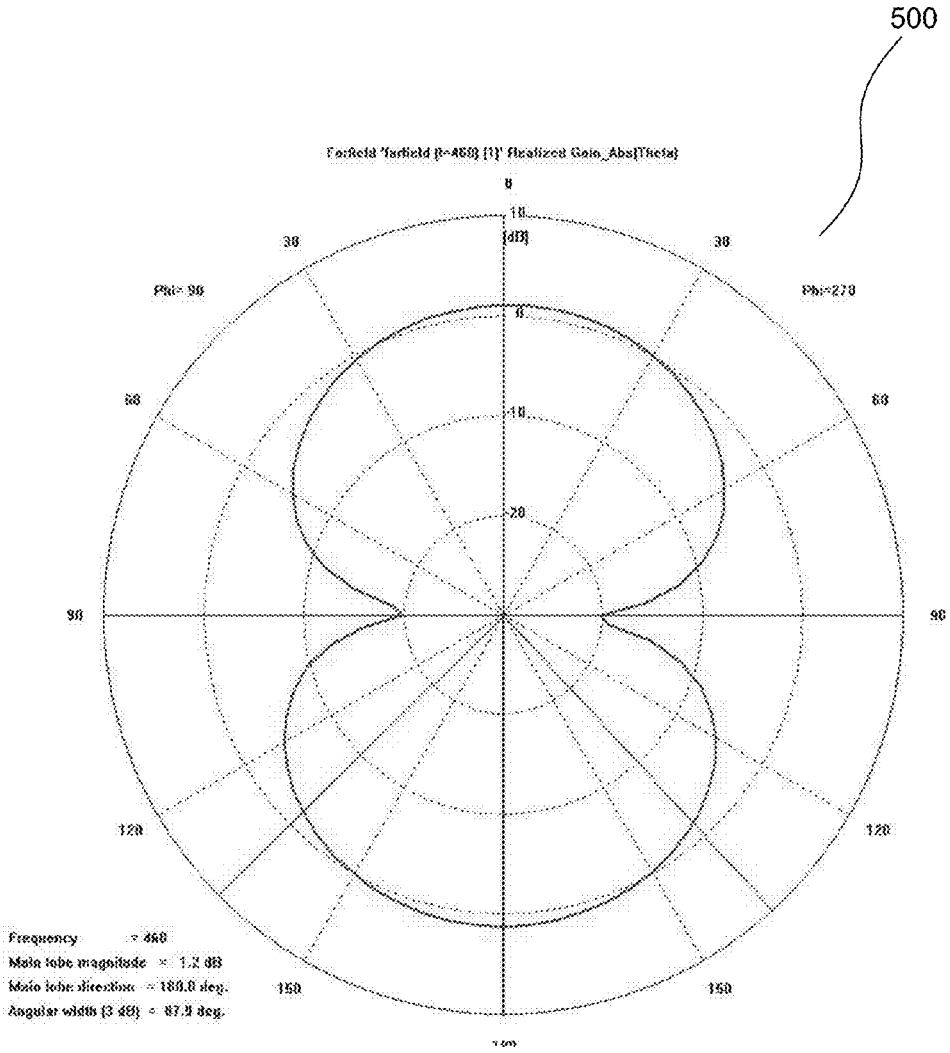
FIG. 5 is an H-plane radiation pattern of the planar dipole antenna of FIG. 1 operating at a frequency of 460 MHz.

FIG. 5 is an H-plane radiation pattern 500 of the planar dipole antenna 100 of FIG. 1 operating at a frequency of 460 MHz. The H-plane radiation pattern 400 represents the far-field conditions along the magnetic field vector along the direction of maximum radiation. Since the antenna 100 is often horizontally polarized, the H-plane coincides with the vertical elevation plane. The H-plane lies at a right angle to the E-plane. Thus, the E-plane radiation pattern 400 of FIG. 4 may be combined with the H-plane radiation pattern 500 of FIG. 5 to visualize a three-dimensional view of the radiation pattern of the antenna 100. For example, the combination of the E-plane radiation pattern 400 and the H-plane radiation pattern 500 may form a doughnut shaped radiation pattern around the antenna 100. A doughnut shaped radiation pattern may be ideal for surface mounted applications because the majority of the radiated energy escaping the antenna is directed to the intended receivers.

Figure 6:
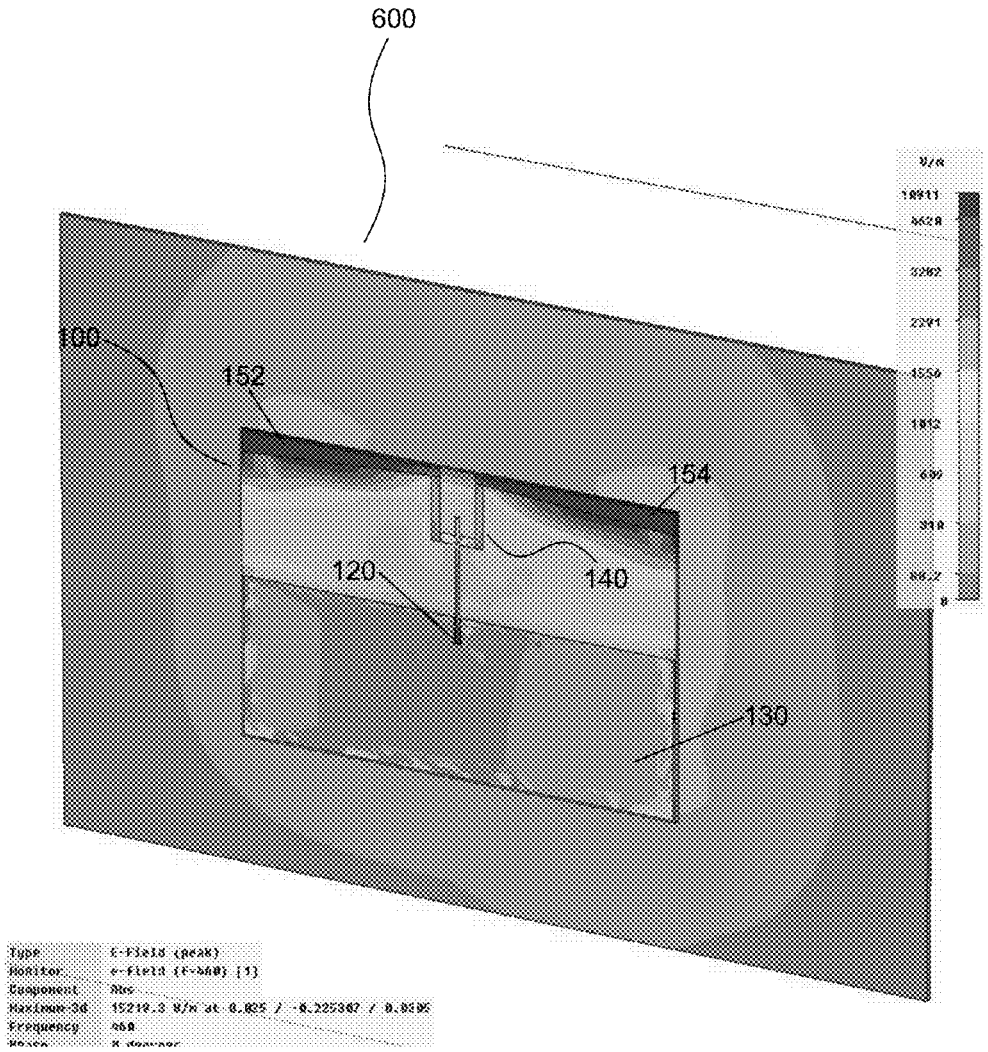
FIG. 6 is an E-field strength graph of the planar dipole antenna of FIG. 1 operating at a frequency of 460 MHz.

FIG. 6 is an E-field strength graph 600 of the planar dipole antenna 100 of FIG. 1 operating at a frequency of 460 MHz. The E-field strength graph 600 shows the electric field strength in volts per meter (V/m) at a distance of 1 meter from the antenna 100 operating at a frequency of 460 MHz. As shown in the E-field strength graph 600, the antenna 100 achieves electric field strength of 10911 V/m along the radiating elements 152, 154 of the antenna 100.

Figure 7:
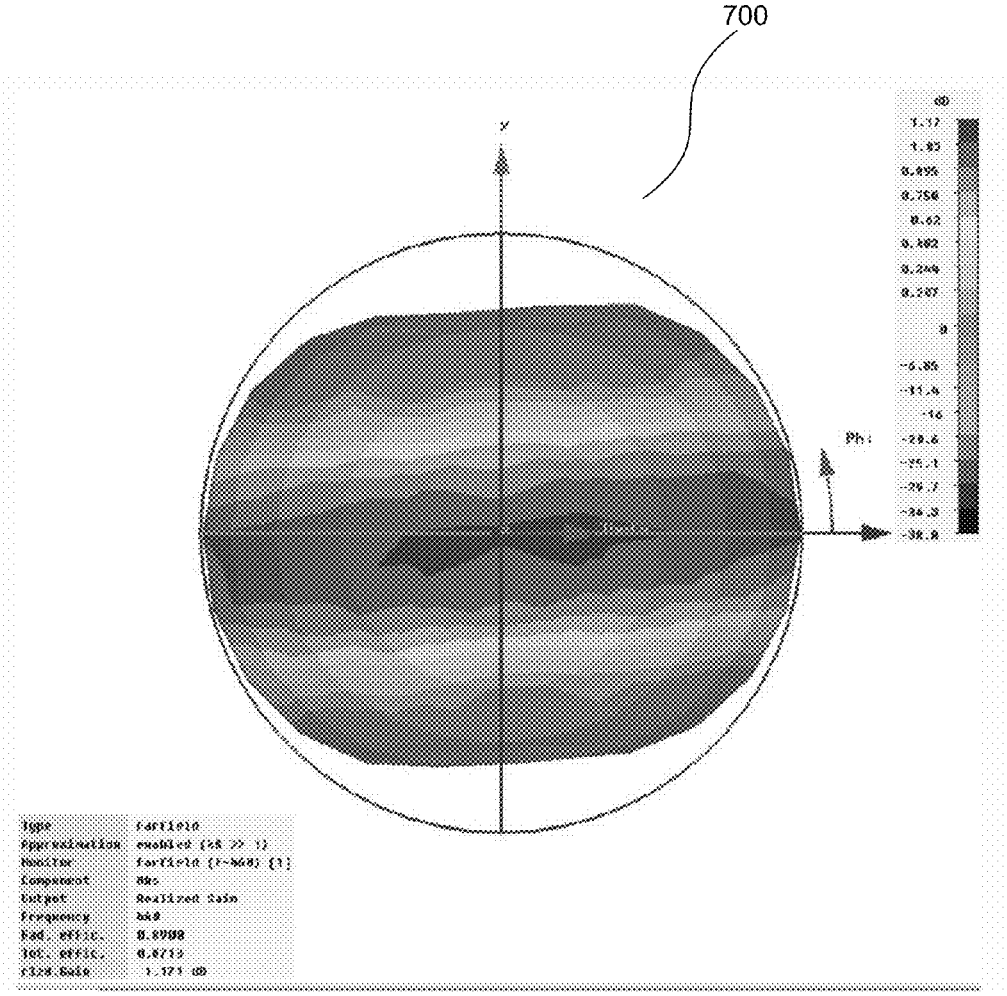
FIG. 7 is a far field radiation graph of the planar dipole antenna of FIG. 1 operating at a frequency of 460 MHz.

FIG. 7 is a far field radiation graph 700 of the planar dipole antenna 100 of FIG. 1 operating at a frequency of 460 MHz. The far field radiation graph 700 shows the realized gain of the antenna 100 across the theta axis. The realized gain of the antenna 100 may represent the power gain, in dB, of the antenna 100 reduced by any losses due to impedance mismatches. As shown in FIG. 3, the impedance mismatch of the antenna 100 is approximately minimized at a frequency of 460 MHz. Thus, the far field radiation graph 700 shows a maximum realized gain of approximately 1.17 dB for the antenna 100 operating at a frequency of 460 MHz.

Figure 8:
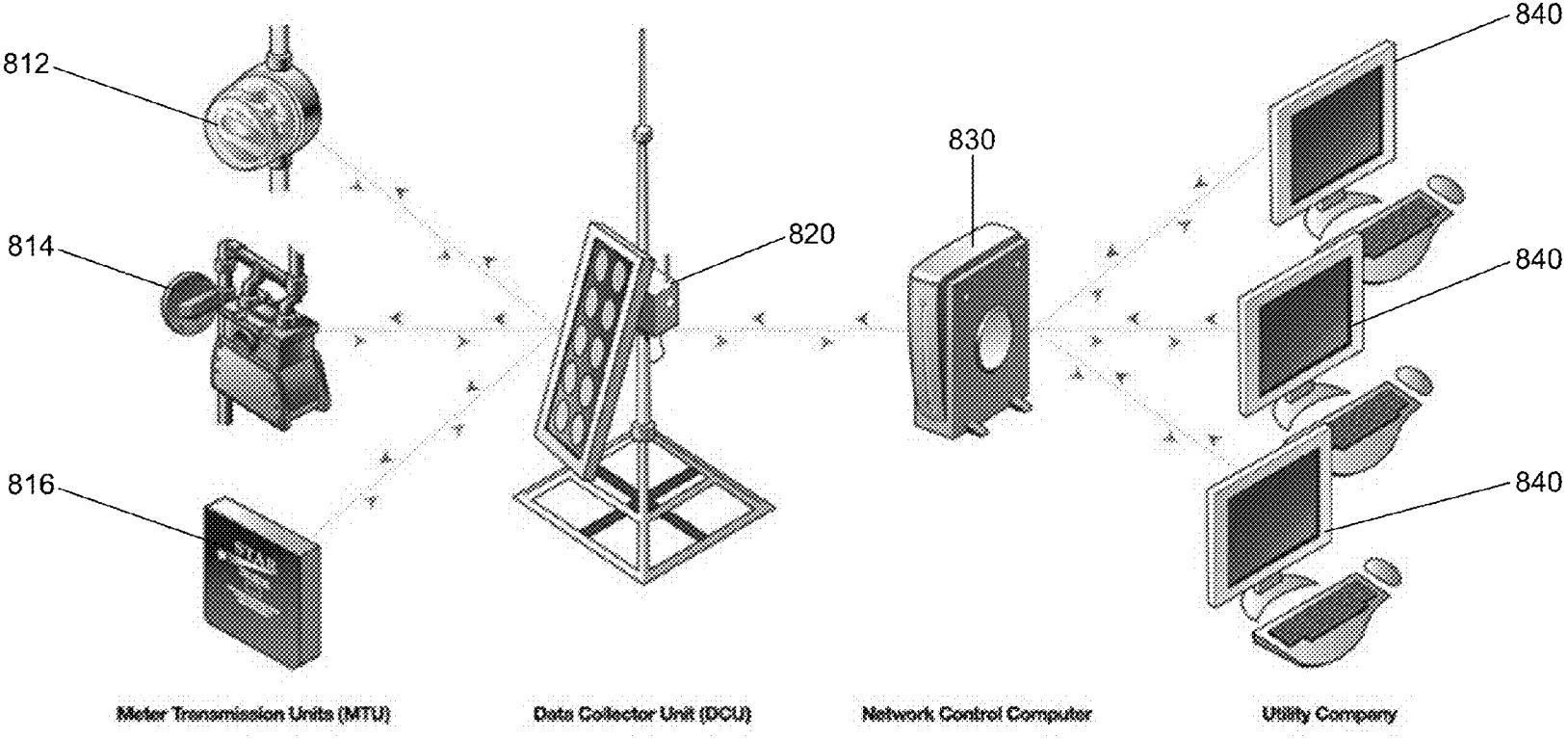
FIG. 8 is a block diagram of a remote meter reading system with meter transmission units utilizing the planar dipole antenna of FIG. 1.

FIG. 8 is a block diagram of a remote meter reading system 800 with meter transmission units (MTUs) 812, 814, 816 utilizing the planar dipole antenna 100 of FIG. 1. Not all of the depicted components may be required, however, and some implementations may include additional components. Variations in the arrangement and type of the components may be made without departing from the spirit or scope of the claims as set forth herein. Additional, different or fewer components may be provided.

The remote meter reading system 800 may include an electric MTU 812, a gas MTU 814, a water MTU 816, one or more data collector units (DCU) 820, a network control computer (NCC) 830, and utility company network devices 840. The water MTU 816 may be a small, permanently sealed module that is connect to a water meter. The water MTU 816 is discussed in more detail in FIG. 12 below. The electric MTU 812 and the gas MTU 814 may be small permanently sealed modules integrated into gas and electric meters. The electric MTU 812 is discussed in more detail in FIG. 10 below and the gas MTU 814 is discussed in more detail in FIG. 11 below.

In operation, the MTUs 812, 814, 816 may read their associated meters and may transmit the meter readings and/or meter related information at customer-specified intervals, such as five minutes. The MTUs 812, 814, 816 may utilize the antenna 100 to transmit the information over a Federal Communications Commission (FCC) licensed wireless channel, such as 460 MHz. The transmitted information may be received by a remote system, such as a DCU 820 covering the geographic area where the MTUs 812, 814, 816 are located. The DCUs 820 may be deployed such that each MTU 812, 814, 816 is located within a mile of a DCU 820; however in some cases the MTUs 812, 814, 816 may located more than a mile from a DCU 820. The operations of the MTUs 812, 814, 816 are discussed in more detail in FIG. 9 below.

The DCU 820 may receive, process, and store the meter reading information transmitted from the MTUs 812, 814, 816 over individual 450 MHz to 470 MHz radio frequencies. The DCU 820 may then transmit the meter reading information to the NCC 830 over a communications network, such as a fiber optic network, a cellular network, an Ethernet network, a Wi-Fi network, a WiMAX network, or generally any wired or wireless network capable of transmitting data. The DCU 820 may send commands and alerts back to the MTUs 812, 814, 816 via Part 90 radio technology.

The NCC 830 may collect, validate, process and store the data received from the DCU 820. The NCC may provide the utility company network devices 840 with access to comprehensive account information. The utility company network devices may interface with various departments of a utility company, such as billing, customer service, and operations. The NCC 830 may communicate information to the utility company network devices 840 over any wired or wireless network. The NCC 830 may maintain an account number, meter type, MTU identifier, meter serial number and alarm parameters for each utility meter in the remote meter reading system 800. The NCC 830 may send a message when an alarm is inserted in the database.

Figure 9:
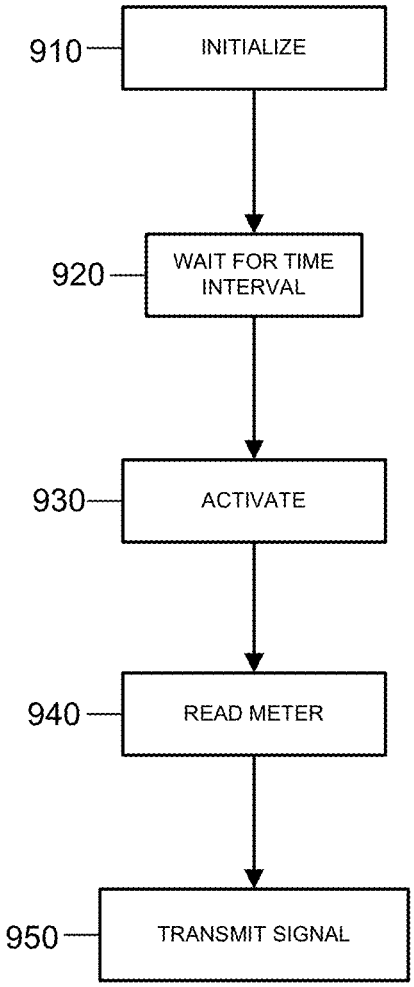
FIG. 9 is a flowchart illustrating an operation of a meter transmission unit utilizing the planar dipole antenna of FIG. 1.

FIG. 9 is a flowchart illustrating an operation of a meter transmission unit utilizing the planar dipole antenna of FIG. 1. At step 910, the MTU, such as a water MTU 816, a gas MTU 814, or an electric MTU 812, may power on and initialize. At step 920, the MTU may wait for a time interval. The time interval may be configured by a customer and may be any length of time, such as five minutes or one month. At step 930, once the time interval has elapsed, the MTU activates to perform a meter reading operation. At step 940, the MTU reads the meter. At step 950, the MTU transmits the meter reading information. For example, the meter reading information may be received by a DCU 820. The MTU may then return to step 920 and wait for the time interval to elapse again before re-performing steps 930-950.

Figure 10:
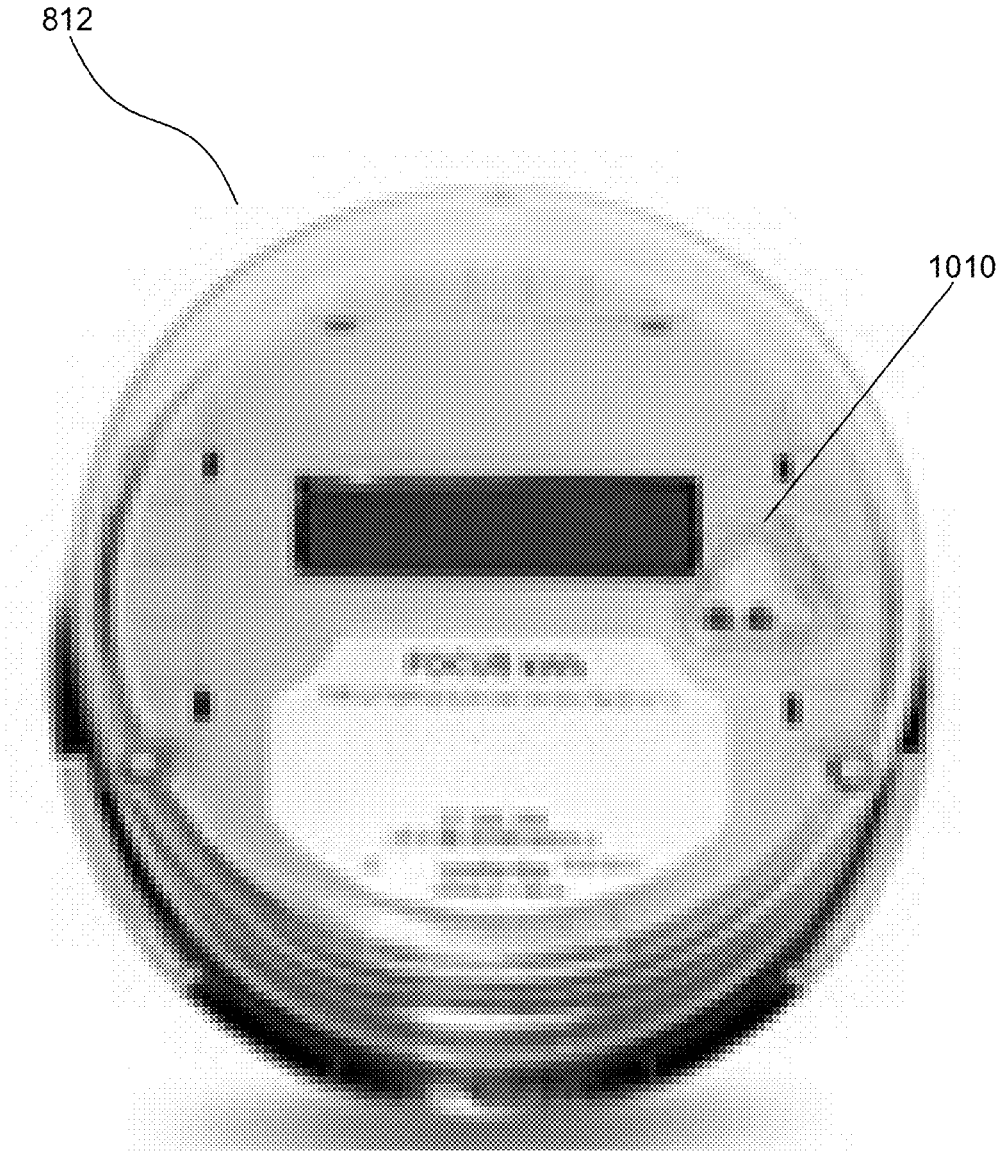
FIG. 10 is an illustration of an electric meter transmission unit utilizing the planar dipole antenna of FIG. 1.

FIG. 10 is an illustration of an electric meter transmission unit 812 utilizing the planar dipole antenna 100 of FIG. 1. The electric MTU 812 includes an antenna mounting area 1010. The antenna 100 may be mounted to the electric MTU 812 in or around the antenna mounting area 1010, such as on an outside surface of the electric MTU 812. Alternatively, the antenna 100 may be mounted below the faceplate of the electric MTU 812, such as on an inside surface of the electric MTU 812. Alternatively, the antenna 100 may be mounted to any other internal or external component of the electric MTU 812.

The electric MTU 812 may include a backup battery to ensure continual operation and receipt of data during power outages. The electric MTU 812 may include a memory to store up to 30 days of meter reading information. The electric MTU 812 may perform two-way communications over secure licensed radio frequencies, such as 450 MHz to 470 MHz. The wireless communication range of the electric MTU 812 may be at least a mile. The electric MTU 812 may transmit up to 288 meter readings per day and may maintain clock accuracy. The electric MTU 812 may also perform on-demand meter readings. In addition to meter reading information, the electric MTU 812 may transmit account information, battery condition, peak demand, tamper status, and outage information.

Figure 11:
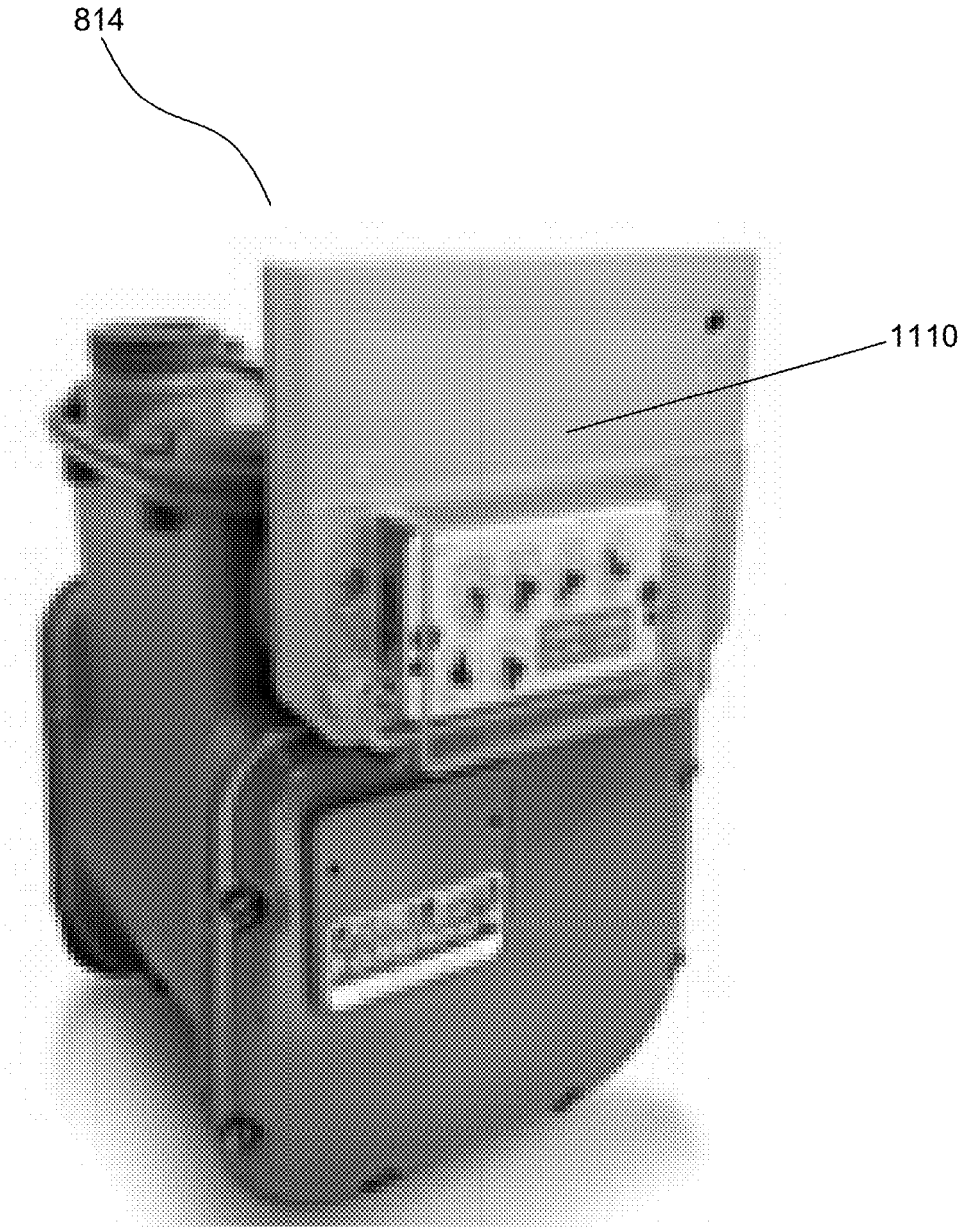
FIG. 11 is an illustration of a gas meter transmission unit utilizing the planar dipole antenna of FIG. 1.

FIG. 11 is an illustration of a gas meter transmission unit 814 utilizing the planar dipole antenna 100 of FIG. 1. The gas MTU 814 may include an antenna mounting area 1110. The antenna 100 may be mounted in or around the antenna mounting area 1110, such as to an external surface of the gas MTU 814. Alternatively, the antenna 100 may be mounted below the enclosure of the gas MTU 814, such as on an inside surface of the gas MTU 814. Alternatively, the antenna 100 may be mounted to any other internal or external component of the gas MTU 814.

The gas MTU 814 may include a battery, such as a lithium-ion battery. The gas MTU 814 may be directly mounted to a gas meter, such as not to interrupt a customer's gas service. Alternatively, the gas MTU 814 may be indirectly mounted to a gas meter. The gas MTU 814 may perform two-way communications over secure licensed radio frequencies, such as 450 MHz to 470 MHz. The wireless communication range of the gas MTU 814 may be at least a mile. The gas MTU 814 may be hermetically sealed and capable of being deployed in harsh basement and outdoor conditions. The gas MTU 814 may be capable of dual port operation, such as to handle compound meters or multiple-meter installations, including gas and water combinations. In addition to meter reading information, the gas MTU 814 may transmit account information, battery condition, peak demand, tamper status, and outage information.

Figure 12:
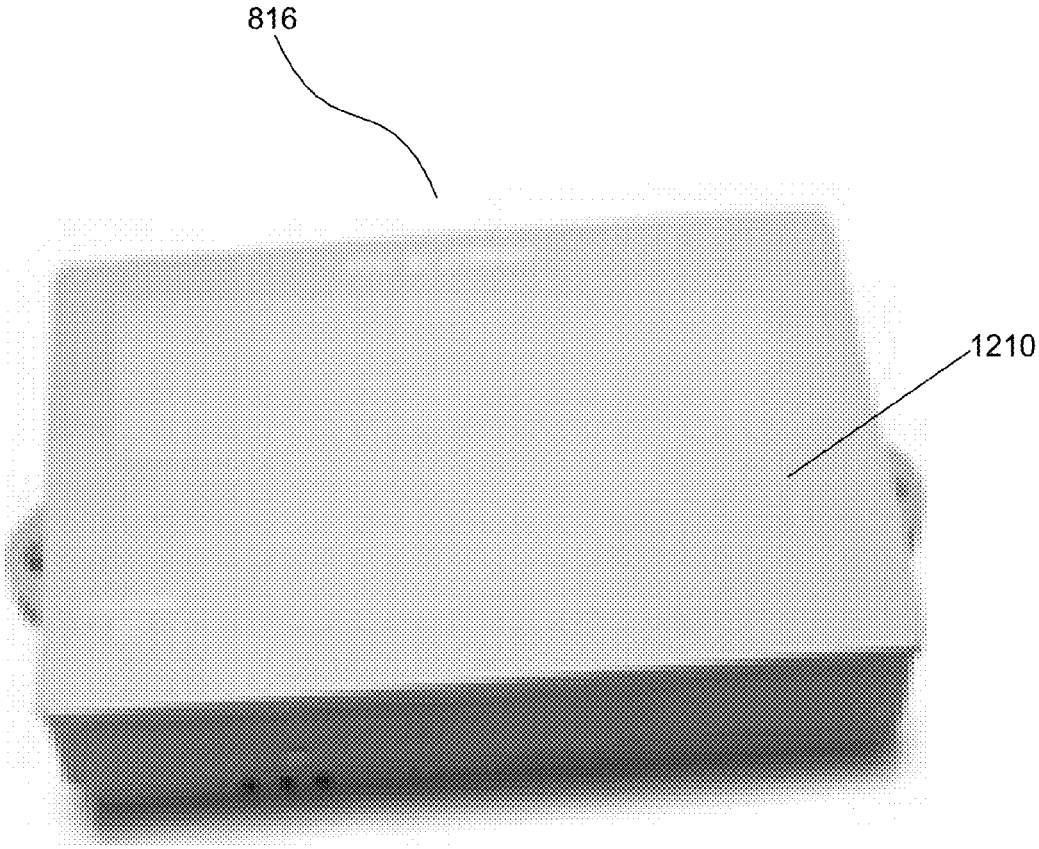
FIG. 12 is an illustration of a water meter transmission unit utilizing the planar dipole antenna of FIG. 1.

FIG. 12 is an illustration of a water meter transmission unit 816 utilizing the planar dipole antenna 100 of FIG. 1. The water MTU 816 may include an antenna mounting area 1210. The antenna 100 may be mounted in or around the antenna mounting area 1210, such as on the outside of the water MTU 816. Alternatively, the antenna 100 may be mounted below the enclosure of the water MTU 816, such as on the inside of the water MTU 816. Alternatively, the antenna 100 may be mounted to any other internal or external component of the water MTU 816.

The water MTU 816 may include a battery, such as a lithium ion battery. The water MTU 816 may perform two-way communications over secure licensed radio frequencies, such as 450 MHz to 470 MHz. The wireless communication range of the water MTU 816 may be at least a mile. The water MTU 816 may be capable of being deployed in harsh basement and pit conditions. The water MTU 816 may be compatible with all pulse and encoder-register water meters that provide electronic output. The water MTU 816 may be capable of dual port operation, such as to handle compound meters or multiple-meter installations, including gas and water combinations. In addition to meter reading information, the gas MTU 812 may transmit account information, battery condition, peak demand, tamper status, and outage information.

The above disclosed subject matter is to be considered illustrative, and not restrictive, and the appended claims are intended to cover all such modifications, enhancements, and other embodiments, which fall within the true spirit and scope of the description. Thus, to the maximum extent allowed by law, the scope is to be determined by the broadest permissible interpretation of the following claims and their equivalents, and shall not be restricted or limited by the foregoing detailed description.

We claim:

1. A planar dipole antenna comprising:

a substrate;

a ground element disposed on the substrate having a substantially rectangular shape;

a feed point to which an input signal is supplied, the feed point being arranged adjacent to a side of the ground element;

a matching element disposed on the substrate and connected to the feed point, the matching element comprising a central bar connected to a first arm and a second arm, wherein the central bar extends from the feed point, and the first and second arms are substantially symmetrically disposed on the substrate in respect to the central bar;

a first radiating element disposed on the substrate having a substantially trapezoidal shape and connected to the matching element, the first radiating element extending from the first arm of the matching element; and a second radiating element disposed on the substrate having a substantially trapezoidal shape and connected to the matching element, the second radiating element extending from the second arm of the matching element, wherein the first radiating element and the second radiating element are substantially symmetrically disposed on the substrate in respect to the central bar of the matching element.

2. The planar dipole antenna of claim 1 wherein the planar dipole antenna has a substantially low Q factor such that near field detuning of the planar dipole antenna is substantially minimized.

3. The planar dipole antenna of claim 1 wherein the impedance of the antenna at a resonant frequency, including the matching element, substantially matches that of the feed point where the input signal is supplied.

4. The planar dipole antenna of claim 1 wherein the first radiating element extends from a distal end of the first arm in respect to the central bar and the second radiating element extends from a distal end of the second arm in respect to the central bar.

5. The planar dipole antenna of claim 4 wherein the distal ends of the first and second arms in respect to the central bar extend further than a distal end of the central bar in respect to the feed point.

6. The planar dipole antenna of claim 1 wherein the first radiating element is connected substantially perpendicularly to the first arm of the matching element and the second radiating element is connected substantially perpendicularly to the second arm of the matching element.

7. The planar dipole antenna of claim 1 wherein the substrate further comprises a first surface and a second surface, and the ground plane, matching element, first radiating element and second radiating element are disposed on the first surface of the substrate.

8. The planar dipole antenna of claim 7 wherein a second ground plane is disposed on the second surface of the substrate.

9. The planar dipole antenna of claim 1 wherein the matching element has a form factor comprising of at least one of a three finger-like form factor, a pitchfork-like form factor, a trident-like form factor, or a three prong-like form factor.

10. The planar dipole antenna of claim 1 wherein the ground element, the matching element, the first radiating element and the second radiating element comprise at least one of a copper material, an aluminum material, or a brass material.

11. The planar dipole antenna of claim 1 wherein the substrate comprises at least one of a fiberglass reinforced epoxy resin or a Bismaleimide-triazine resin.

12. The planar dipole antenna of claim 1 wherein the planar dipole antenna operates at a resonant frequency in the range of 450 MHz to 470 MHz.

13. The planar dipole antenna of claim 1 wherein the ground element comprises an opening on the side of the ground element adjacent to the feed point.

14. The planar dipole antenna of claim 13 wherein the feed point is located within the opening of the ground element.

15. The planar dipole antenna of claim 1 wherein the planar dipole antenna is horizontally polarized.

16. A planar dipole antenna comprising:

a substrate;

a ground element disposed on the substrate having a rectangular shape;

a feed point to which an input signal is supplied, the feed point being arranged adjacent to the ground element;

a matching element disposed on the substrate and connected to the feed point;

a first radiating element disposed on the substrate having a trapezoidal shape and connected to the matching element; and a second radiating element disposed on the substrate having a trapezoidal shape and connected to the matching element, wherein the first radiating element and the second radiating element are symmetrically disposed on the substrate in respect to the matching element;

wherein near-field detuning of the antenna is substantially eliminated.

17. The planar dipole antenna of claim 16 wherein the impedance of the antenna, including the matching element, matches that of the feed point where the input signal is supplied.

18. The planar dipole antenna of claim 16 wherein the planar dipole antenna is horizontally polarized.

19. A method of manufacturing a planar dipole antenna comprising:

forming a substrate;

disposing a ground element on the substrate, wherein the ground element has a substantially rectangular shape;

connecting a feed point to the substrate, the feed point being arranged adjacent to a side of the ground element, wherein an input signal is supplied to the feed point;

disposing a matching element on the substrate and connected to the feed point, the matching element comprising a central bar connected to a first arm and a second arm, wherein the central bar extends from the feed point, and the first and second arms are substantially symmetrically disposed on the substrate in respect to the central bar;

disposing a first radiating element on the substrate having a substantially trapezoidal shape and connected to the matching element, the first radiating element extending from the first arm of the matching element; and disposing a second radiating element on the substrate having a substantially trapezoidal shape and connected to the matching element, the second radiating element extending from the second arm of the matching element, wherein the first radiating element and the second radiating element are substantially symmetrically disposed on the substrate in respect to the central bar of the matching element.

20. The method of claim 19 wherein the first radiating element extends from a distal end of the first arm in respect to the central bar and the second radiating element extends from a distal end of the second arm in respect to the central bar.

21. The method of claim 20 wherein the distal ends of the first and second arms in respect to the central bar extend further than a distal end of the central bar in respect to the feed point.

22. The method of claim 19 wherein the first radiating element is connected substantially perpendicularly to the first arm of the matching element and the second radiating element is connected substantially perpendicularly to the second arm of the matching element.

23. The method of claim 19 wherein the matching element has a form factor comprising of at least one of a three finger-like form factor, a pitchfork-like form factor, a trident-like form factor, or a three prong-like form factor.

24. The method of claim 19 wherein the ground element, the matching element, the first radiating element and the second radiating element comprise at least one of a copper material, an aluminum material, or a brass material.

25. The method of claim 19 wherein the substrate comprises at least one of a fiberglass reinforced epoxy resin or a Bismaleimide-triazine resin.

* * * * *